US007108208B2

(12) United States Patent
Nilsson et al.

(10) Patent No.: US 7,108,208 B2
(45) Date of Patent: Sep. 19, 2006

(54) METHOD AND DEVICE FOR THE CONTROL OF A CRUSHER

(75) Inventors: Mattias Nilsson, Sjobo (SE); Kent Nilsson, Malmo (SE); Richard Bern, Svedala (SE); Per Gothenqvist, Svedala (SE); Anders Nilsson, Limhamn (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 11/087,855

(22) Filed: Mar. 24, 2005

(65) Prior Publication Data

US 2005/0242217 A1 Nov. 3, 2005

(30) Foreign Application Priority Data

Mar. 25, 2004 (SE) ..... 0400770

(51) Int. Cl.
*B02C 2/00* (2006.01)

(52) U.S. Cl. ..... 241/36
(58) Field of Classification Search ..... 241/30, 241/37, 34, 207, 33, 36
See application file for complete search history.

(56) References Cited

U.S. PATENT DOCUMENTS 1,894,601 A 1/1933 Symons
4,856,716 A * 8/1989 Burstedt ..... 241/30
5,580,003 A * 12/1996 Malone et al. ..... 241/30

* cited by examiner

*Primary Examiner*—Faye Francis
(74) *Attorney, Agent, or Firm*—Drinker Biddle & Reath LLP

(57) ABSTRACT

A crusher includes a replaceable first crushing member having a first crusher surface and a replaceable second crushing member having a second crusher surface. The co-operation of the crusher surfaces is defined by at least one crusher setting parameter. From measurements of a quality parameter, which relates to the nature of the crushed material, on at least two different occasions during the service life of a set of replaceable first and second crushing members and on each occasion for at least two different settings of the crusher setting parameter, a control function can be determined that describes a value, of the at least one crusher setting parameter, which on a given occasion gives a crushed material the quality parameter of which is substantially optimal. The control function is utilized for the adjustment of the crusher setting parameter for a subsequent set of replaceable first and second crushing members in such a way that on a given occasion for the subsequent set of replaceable crushing members, a crushed material is also obtained, the quality parameter of which is substantially optimal.

12 Claims, 8 Drawing Sheets

III

METHOD AND DEVICE FOR THE CONTROL OF A CRUSHER

TECHNICAL FIELD

The present invention relates to a method to control a crusher, which comprises a replaceable first crushing member having a first crusher surface and a replaceable second crushing member having a second crusher surface, which crushing members are arranged to be brought toward each other in a reciprocating motion and between themselves crush a material that passes between the crusher surfaces in a direction having a vertically downwardly directed direction component.

The invention also relates to a crusher, which is of the type gyratory crusher or jaw crusher and comprises the replaceable crushing members mentioned above.

The invention also relates to a control system for the control of a crusher, which is of the kind mentioned above.

BACKGROUND OF THE INVENTION

When crushing a hard material, for instance stone or ore, a crusher having a crushing gap, also called crushing chamber, is frequently utilized, where material is fed in from above and is crushed between two crusher surfaces that are brought toward each other and between which the hard material is crushed. An example of such a crusher is a gyratory crusher, which has a crushing head provided with an inner crushing shell, which head is fastened on a shaft and during operation describes a gyratory motion, and an outer crushing shell surrounding the inner crushing shell. The fed-in material is then crushed in a plurality of steps between the inner and outer shell. An additional example of a crusher of the type mentioned above is a jaw crusher in which a fed-in material is crushed between a fixed first jaw plate and a second jaw plate mounted on a movable jaw, which second jaw plate moves toward the first jaw plate in a reciprocating motion and in a plurality of steps successively crushes a fed-in material.

After a time of operation, crushing gives rise to wearing of the crusher surfaces and an increased distance between them. WO 93/14870 describes a method to compensate for this wear. In the method described in WO 93/14870, the shortest distance between the inner shell and the outer shell is calibrated on a plurality of occasions during the service life of a first pair of shells. Based on the same data, it is possible to predict how this shortest distance will be altered over time for a new pair of shells and to compensate for this alteration so that the shortest distance between the inner and outer shell in said new pair of shells is kept substantially constant during the entire service life of the shells.

However, the above-described method of compensating for wear has the disadvantage that it cannot produce a crushed material having predictable properties during the service life of a pair of shells.

SUMMARY OF THE INVENTION

It is an object of the present invention to provide a method to compensate for wear in a crusher, which method entails that the crushed material will have predictable properties during the service life of a pair of crusher surfaces.

This object is attained by a method according to the preamble, which method is characterized in that the cooperation of the crusher surfaces is defined by at least one crusher setting parameter, that at least one quality parameter, which relates to the nature of the crushed material, is measured on at least two different occasions during the service life of at least one set of replaceable first and second crushing members and on each occasion for at least two different settings of the above-mentioned crusher setting parameter, and that the measured quality parameter for said set of replaceable crushing members is utilized for the determination of a control function that describes the value of the crusher setting parameter that on a given occasion gives a crushed material the quality parameter of which is substantially optimal, and that this control function is utilized for the adjustment of the crusher setting parameter for a subsequent set of replaceable first and second crushing members in such a way that on a given occasion for the same subsequent set of replaceable crushing members, a crushed material is provided said quality parameter which is substantially optimal.

An advantage of this method is that measurements that are made for a set of replaceable crushing members can be utilized for making sure that the crushed material for a subsequent set of crushing members gets optimally good properties without any, or at least no more than one or a few, measurements needing to be made during operation using the same subsequent set. Thus, a crushed material of optimum nature according to the criteria set up can be obtained, with a minimum of effort in the form of measurements. This is especially advantageous when the material that should be crushed has similar properties over a long period of time. One example is crushing in connection with mining, where the fed-in material may have similar properties during a plurality of years and where, during this period, a great number of sets of replaceable crushing members are consumed. In the method, a compensation is obtained for the effect of the wear on the geometry of the crushing gap, also called crushing chamber, that is formed between the two crusher surfaces. Contrary to the known technique, where compensation solely takes place for the alteration of the shortest distance between the crusher surfaces, according to a preferred embodiment of the invention, a compensation is obtained for the geometrical alteration of the entire crushing gap and, thereby, also for how this geometrical alteration will effect the nature of the crushed material.

Conveniently, the determination of the control function involves that a criterion, which defines what is an optimum quality parameter, is selected, that the values of the crusher setting parameter that best fulfil the same criterion is determined from the quality parameters measured on the respective occasions, and that the control function is determined as a curve fitted to these values of the crusher setting parameter. The fitted curve entails that a few measurements are enough for the provision of a control function that on an arbitrary occasion during the service life of a subsequent set of replaceable crushing members gives the value of the crusher setting parameter that on this arbitrary occasion gives a substantially optimum quality parameter, i.e., a maximum compliance with the chosen criterion. It will be appreciated that the chosen criterion does not need to have been the exact subject of the measurements, but it is enough that values of the chosen criterion can be determined from the data having been measured.

According to a preferred method, quality parameters are utilized that have been measured for at least two different sets of replaceable crushing members upon the determination of the control function. An advantage of this is that the accuracy of the calculation of the control function becomes greater. An additional advantage, in particular if one or more measurements are carried out, for example, every second or every fourth set of replaceable crushing members, is that the control function will be adapted according to alterations of the properties over time of the fed-in material.

Preferably, measured quality parameters from at least three different occasions are utilized upon the determination of the control function. By making the measurements on at least three occasions during the service life of a set of replaceable crushing members, a considerably safer determination of a control function is obtained. Even more preferred, the control function should be determined from values that have been measured on 5 to 10 different occasions during the service life of a set of crushing members.

Preferably, each measurement is carried out for at least three different settings of the crusher setting parameter. At least three different settings of the crusher setting parameter, and even more preferred three to five different settings, makes it possible to obtain also non-linear dependences of the quality parameter and to take these into consideration upon the determination of the control function.

According to a preferred embodiment, if required, the control function is extrapolated in order to cover the entire time during which the subsequent set of replaceable crushing members is used. An advantage of this is that it is not necessary to make a measurement precisely at the start of operation since the control function may be extrapolated backward to 0 h of operation. Another advantage is that the control function may be extrapolated to operation occasions falling after the last measuring point. An advantage of this is that the control function works also when a set of crushing members is utilized longer than the instant of time of operation at which a last measurement has been made for a preceding set of crushing members.

Preferably, said at least one crusher setting parameter is selected from among: the shortest distance between the first crusher surface and the second crusher surface, the power generated by a motor driving the crusher, the quantity of material fed into the crusher, the rotation speed of a shaft rotating a crushing head in a gyratory crusher, the horizontal stroke of the lower end of the shaft in the gyratory crusher, the pressure by which the shaft in the gyratory crusher loads a setting device that sets the position of the shaft in the vertical direction, the rotation speed of a flywheel driving a movable jaw in a jaw crusher, and the horizontal stroke of the lower end of the movable jaw in a jaw crusher. These crusher setting parameters all have the advantage that they are easy to control and that they have a substantial and repeatable effect on the nature of the crushed material.

According to an even more preferred embodiment, said at least one crusher setting parameter comprises a parameter that describes the shortest distance between the first crusher surface and the second crusher surface. The smallest distance between the first and the second crusher surfaces frequently has a very great impact on the nature of the crushed material. Hence, an adjustment of said crusher setting parameter, either alone or in combination with the adjustment of also other crusher setting parameters, is an efficient way to adjust the effect of the first and second crusher surfaces.

Conveniently, said at least one quality parameter of the crushed material is selected from among: grain shape, size distribution, strength value, quantity of crushed material per time unit, and quantity of crushed material per energy unit. These measurements indicate quality parameters having effect on the commercial value of the crushed material, and which, because of that, there is reason to optimise according to criteria that may vary from one time to another. By means of the control function, the method according to the invention makes it possible to, on any occasion, provide a crushed product the nature of which gives the highest possible economical yield.

According to a preferred embodiment, said given occasion represents a given operating time, a given quantity of material having been crushed, or a given quantity of energy having been consumed in the crushing. These three parameters frequently have a very good correlation to the wear of the crushing members. Which one of these three parameters, i.e., operating time, quantity of crushed material, and consumed energy, gives the best correlation depends on the application in question and may for each crushing plant be determined from measuring data.

An additional object is to provide a crusher, which has members for such a compensation of the wear in the crusher that the crushed material always will have predictable properties.

This object is attained by a crusher according to the preamble, which crusher is characterized in that the cooperation of the crusher surfaces is defined by at least one crusher setting parameter, the crusher having a control device, which is arranged to, by the utilization of at least one measured quality parameter, which relates to the nature of the crushed material and which has been measured on at least two different occasions during the service life of at least one set of replaceable first and second crushing members and on each occasion for at least two different settings of the above mentioned crusher setting parameter, determine a control function that describes the value of the crusher setting parameter that on a given occasion gives a crushed material the quality parameter of which is substantially optimal, and to utilize this control function of the adjustment of the crusher setting parameter for a subsequent set of replaceable first and second crushing members in such a way that on a given occasion for the same subsequent set of replaceable crushing members, a crushed material can be provided said quality parameter of which is substantially optimal.

Another object of the present invention is to provide a control system for the control of a crusher, which control system can compensate for the wear that arises in the crusher in such a way that the crushed material will have predictable properties during the service life of a pair of crusher surfaces.

This object is attained by a control system for the control of a crusher according to the preamble, which control system is characterized in that it comprises a control device, which is arranged to, by the utilization of at least one measured quality parameter, which relates to the nature of the crushed material and which has been measured on at least two different occasions during the service life of at least one set of replaceable first and second crushing members, the cooperation of the crusher surfaces of which is defined by at least one crusher setting parameter, and on each occasion for at least two different settings of the above mentioned crusher setting parameter, determine a control function that describes the value of the crusher setting parameter that on a given occasion gives a crushed material the quality parameter of which is substantially optimal, and to utilize this control function of the adjustment of the crusher setting parameter for a subsequent set of replaceable first and second crushing members in such a way that on a given occasion for the same subsequent set of replaceable crushing members, a crushed material can be provided said quality parameter of which is substantially optimal.

Additional advantages and features of the invention are evident from the description below and the appended claims.

BRIEF DESCRIPTION OF THE DRAWINGS

The invention will henceforth be described by means of embodiment examples and reference being made to the accompanying drawings.

DETAILED DESCRIPTION OF THE PREFERRED EMBODIMENTS

Figure 1:
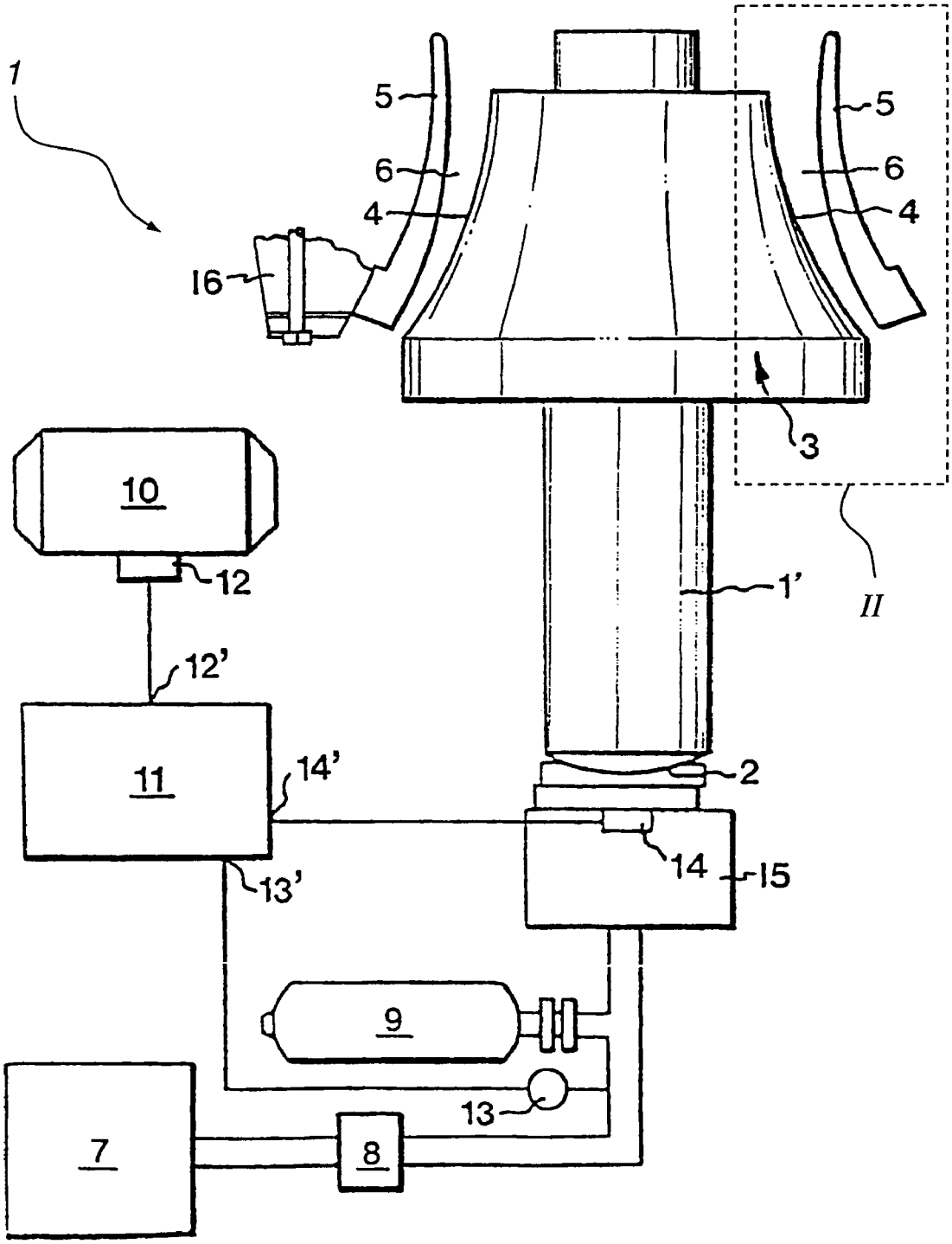
FIG. 1 schematically shows a gyratory crusher having driving and control devices associated therewith.

In FIG. 1, a crusher in the form of a gyratory crusher 1 is schematically shown. The crusher 1 has a shaft 1', which at the lower end 2 thereof is eccentrically mounted. At the upper end thereof, the shaft 1' carries a crushing head 3. A first, inner, crushing shell 4 is mounted on the outside of the crushing head 3. In a machine frame 16, a second, outer, crushing shell 5 has been mounted in such a way that it surrounds the inner crushing shell 4. Between the inner crushing shell 4 and the outer crushing shell 5, a crushing gap 6 is formed, which in axial section, such as is shown in FIG. 1, along a great part of the extension thereof has a decreasing width in the downward direction. The shaft 1', and thereby the crushing head 3 and the inner crushing shell 4, is vertically movable by means of a hydraulic setting device, which comprises a tank 7 for hydraulic fluid, a hydraulic pump 8, a gas-filled container 9 and a hydraulic piston 15. Furthermore, a motor 10 is connected to the crusher, which motor is arranged to bring the shaft 1' and thereby the crushing head 3 to execute a gyratory motion during operation, i.e., a motion during which the two crushing shells 4, 5 approach each other along a rotary generatrix and retreat from each other at a diametrically opposite generatrix. The inner shell 4 and the outer shell 5 are replaceable and together form a set of replaceable crushing members.

In operation, the crusher is controlled by a control device 11, which via an input 12' receives input signals from a transducer 12 arranged at the motor 10, which transducer measures the load on the motor 10, via an input 13' receives input signals from a pressure transducer 13, which measures the pressure in the hydraulic fluid in the setting device 7, 8, 9, 15, and via an input 14' receives signals from a level transducer 14, which measures the position of the shaft 1' in the vertical direction in relation to the machine frame 16. The control device 11 comprises, among other things, a data processor and controls on the basis of received input signals, among other things, the power of the motor 10, the hydraulic fluid pressure in the setting device 7, 8, 9, 15, and thereby also the position of the shaft 1' in the vertical direction.

When the crusher 1 is to be calibrated, feeding in of material is interrupted. The motor 10 continues to be in operation and brings the crushing head 3 to execute the gyratory pendulum motion. Next, the pump 8 increases the hydraulic fluid pressure so that the shaft 1', and thereby the inner shell 4, is raised until the inner crushing shell 4 contacts the outer crushing shell 5. When the inner shell 4 contacts the outer shell 5, a pressure increase arises in the hydraulic fluid, which is recorded by the pressure transducer 13. The vertical position of the inner shell 4 is recorded by the level transducer 14 and this position corresponds to a most slender width of 0 mm of the gap 6. Knowing the gap angle between the inner crushing shell 4 and the outer crushing shell 5, the width of the gap 6 can be calculated at any position of the shaft 1' as measured by the level transducer 14.

When the calibration is finished, a suitable width of the gap 6 is set and feeding in of material to the crushing gap 6 of the crusher 1 is commenced. The fed-in material is crushed a plurality of times in the gap 6 while it is led downward. Ready-crushed material then leaves the gap 6 and is transported away.

Figure 2:
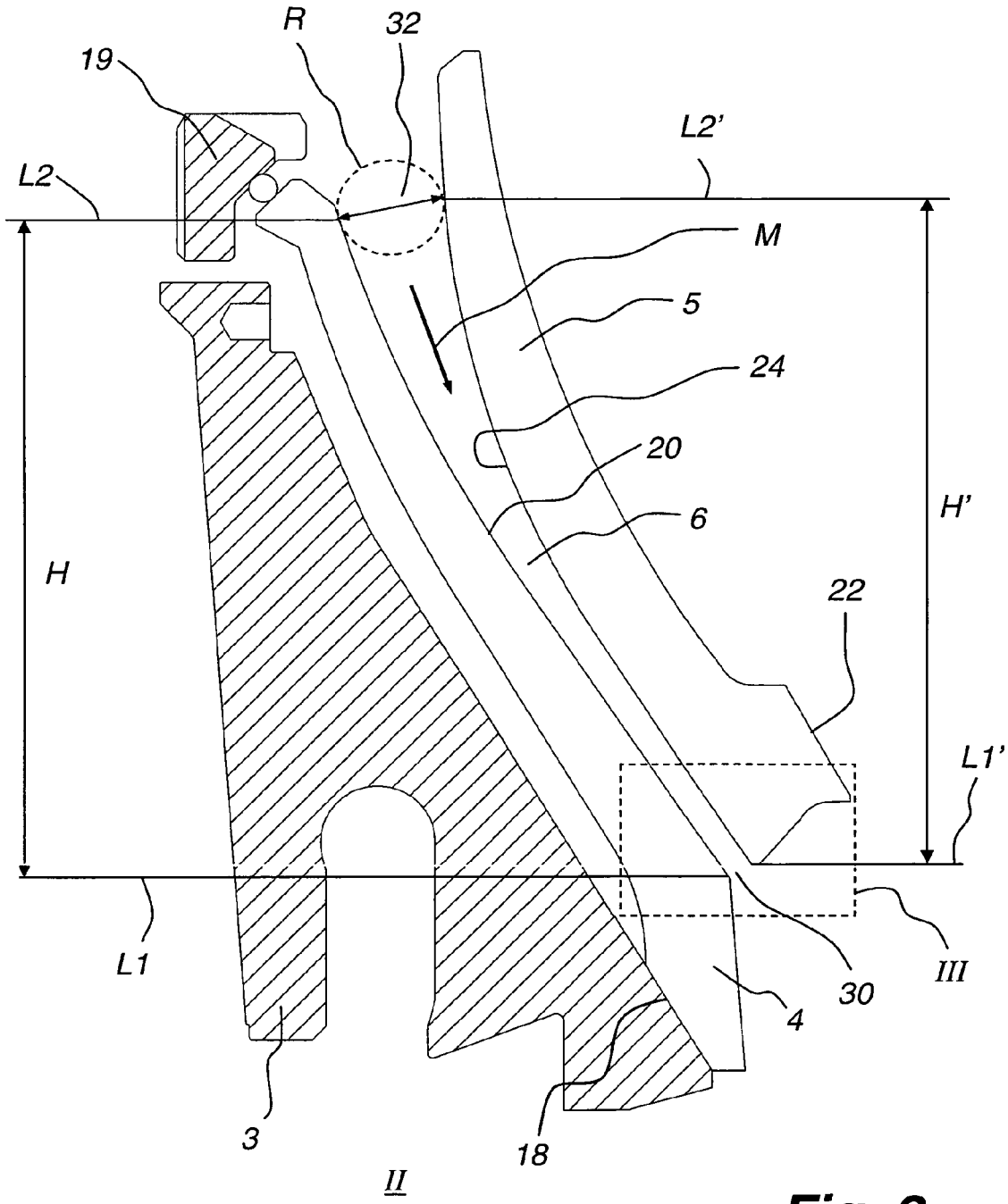
FIG. 2 is a cross-section and shows the Area II, shown in FIG. 1, in enlargement.

FIG. 2 shows more closely the inner crushing shell 4 before crushing has been commenced, i.e., the shell 4 has not yet been subjected to any wear. The shell 4 is carried by the crushing head 3 and abuts by a machined support surface 18 against the same. The shell 4 is locked on the crushing head by a nut 19, as schematically shown in FIG. 2. The inner shell 4 has a first crushing surface 20 against which material fed in is intended to be crushed. The outer crushing shell 5 has a support surface 22, which abuts against the machine frame, not shown in FIG. 2, and a second crushing surface 24. The fed-in material symbolized in FIG. 2 by a substantially spherical stone block R, will accordingly move downward in a direction M, which accordingly has a downwardly directed direction component, while it is crushed a plurality of times between the first crusher surface 20 and the second crusher surface 24 to smaller and smaller sizes.

Figure 3:
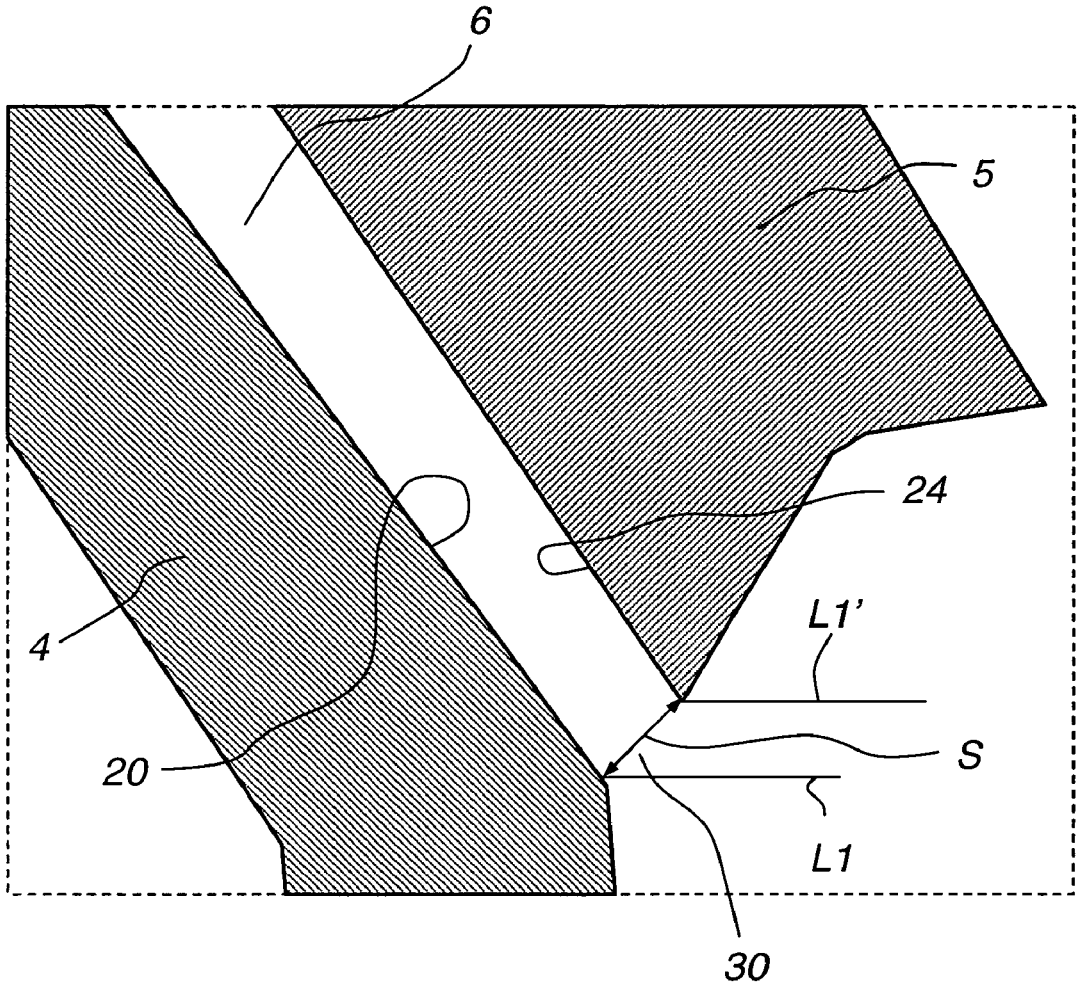
FIG. 3 is a cross-section and shows the Area III, shown in FIG. 2, in enlargement.

FIG. 3 shows the shortest distance S between the inner crushing shell 4 and the outer crushing shell 5. The distance S is usually present farthest down in the crushing gap 6, i.e., where the crushed material is just about to leave the crushing gap 6 via an outlet 30. After the material has passed out through the outlet 30, generally no additional crushing of the material takes place before it leaves the crusher 1. The distance S, which frequently is called CSS (Closed Side Setting), has an effect on the properties of the crushed material leaving the crusher 1. As has been mentioned above, the shaft 1' executes a gyratory motion and thereby the distance at a certain point between the inner shell 4 and the outer shell 5 will vary during the motion of the shaft 1'. The distance S, and CSS, relates to the absolutely shortest distance between the shells, i.e., when the inner shell 4 "closes" against the outer shell 5. The crusher surface 20 of the inner shell 4 has a vertical height H (see also FIG. 2) that extends from the outlet 30, which corresponds to a level L1 on the inner shell 4, at which level the distance to the outer shell 5 usually is shortest, i.e., where the distance S usually is at hand, to the inlet 32 of the crushing gap 6. The inlet 32 is the position where material fed in begins to be subjected to crushing between the inner shell 4 and the outer shell 5. The inlet 32 corresponds to a level L2 on the inner shell 4 where the distance to the outer shell 5 usually corresponds to the size of the largest object that is to be crushed in the crusher 1 at the shortest distance S in question, i.e., the distance between the shells at L2 is substantially equal to the diameter of the object R shown in FIG. 2. The crusher surface 24 of the outer shell 5 has a vertical height H' (see also FIG. 2) that extends from the outlet 30, which corresponds to a level L1' on the outer shell 5, at which level the distance to the inner shell 4 usually is shortest, i.e., where the distance S is at hand, to the inlet 32, which corresponds to a level L2' on the outer shell 5 where the distance to the inner shell 4 is substantially equal to the diameter of the object R shown in FIG. 2.

Figure 4:
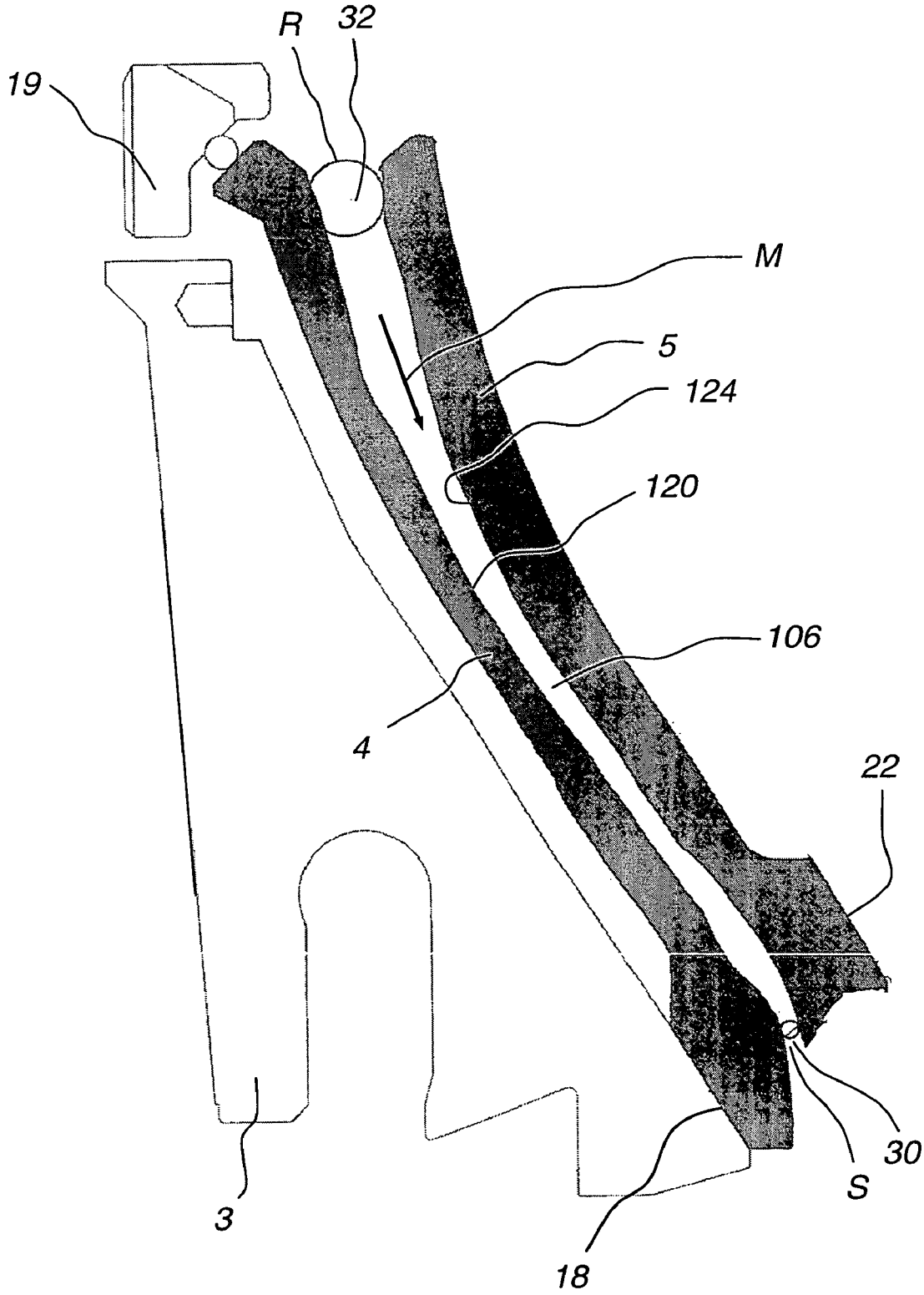
FIG. 4 is a cross-section and shows shells, shown in FIGS. 1–3, after the same having been in operation for a period of time.

In FIG. 4, an example is shown of what the shells 4, 5 shown in FIGS. 1–3 may look like after having been subjected to wear during a time of operation of the crusher 1. As can be seen, after the wear, the inner shell 4 has obtained a crusher surface 120 having a significantly different geometry than the crusher surface 20 shown in FIG. 2. The outer shell 5 has obtained a crusher surface 124 having another geometry than the crusher surface 24 shown in FIG. 2. Thereby, between the shells 4, 5, a crushing gap 106 is formed having another shape than the crushing gap 6 shown in FIG. 2. Among other things, it can be noted that the crushing gap 106 is fairly wide near the inlet 32, and then, in the downward direction, is followed by a long narrow portion where the crusher surfaces 120, 124 are almost entirely parallel. Immediately before the outlet 30, the crushing gap 106 is widened again before the shortest distance S is formed on approximately the same location as in the unused shells. It has now turned out that the crushing gap 106 shown in FIG. 4 gives a significantly different result as to the quality parameters of the crushed material than the crushing gap 6 shown in FIG. 2, even when all crusher setting parameters, including the distance S, are identical.

Figure 5:
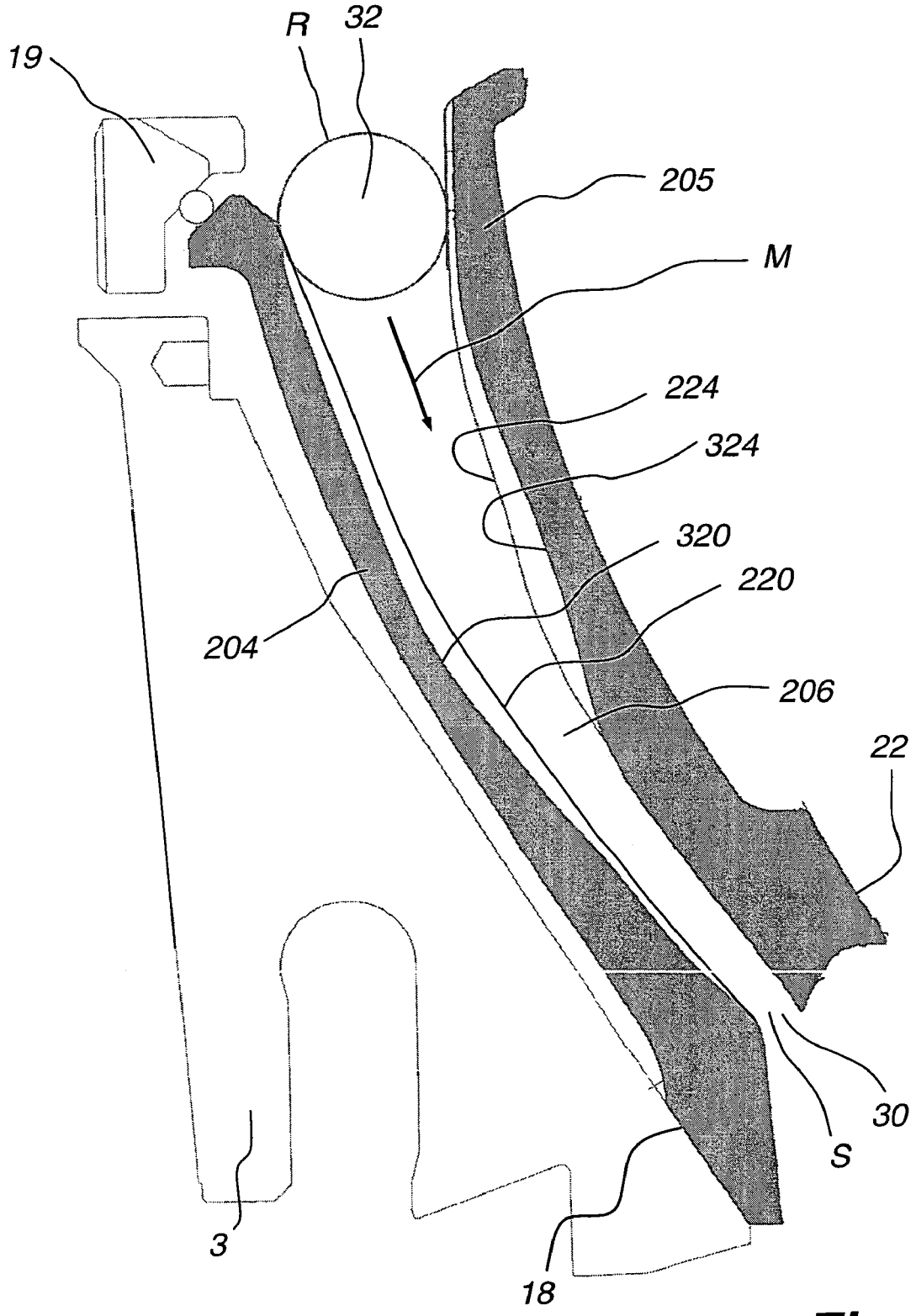
FIG. 5 is a cross-section and shows a comparative example of shells having been in operation for a period of time.

FIG. 5 shows a second example of an inner shell 204 and an outer shell 205, which shells 204, 205 are fastened in a crusher in the similar way as has been described above. The inner shell 204 has one crusher surface 220 when the shell 204 is new and unworn and another crusher surface 320 after a time of wear. The outer shell 205 has one crusher surface 224 when the shell 205 is new and another crusher surface 324 when it is worn. The consequence of this is that the geometry of a crushing gap 206 that is formed between the shells 204, 205 depends on whether the shells are new or if they have been subjected to wear. In the example shown in FIG. 5, the crushing gap 206 has, after a time of wear, become considerably widened in the central portion thereof, while near the outlet 30 it has scarcely been altered at all. Thus, on comparison between FIGS. 2, 4 and 5, it can be observed that the geometry of the crushing gap 6 is altered when the shells 4, 5 are worn. How fast and to what extent the shape of the crushing gap 6 is altered depends among other things on the size, hardness and shape of the fed-in material, and the size into which the material is crushed, as well as on the crusher setting parameters.

Upon crushing by a gyratory crusher, there are, above all, three crusher setting parameters that determine the nature of the crushed material as regards size distribution, grain shape, the quantity of material that can be crushed in the crusher per time unit, the strength, etc. These three parameters are CSS (Closed Side Setting, i.e., the distance S), the rotation speed, i.e., the number of revolutions per minute that the motor 10 gets the shaft 1' to gyrate, as well as the stroke, i.e., the horizontal distance that the centre line of the shaft 1' at the lower end 2 thereof deviates from the centre line of the crusher 1 during the gyratory motion.

Figure 6:
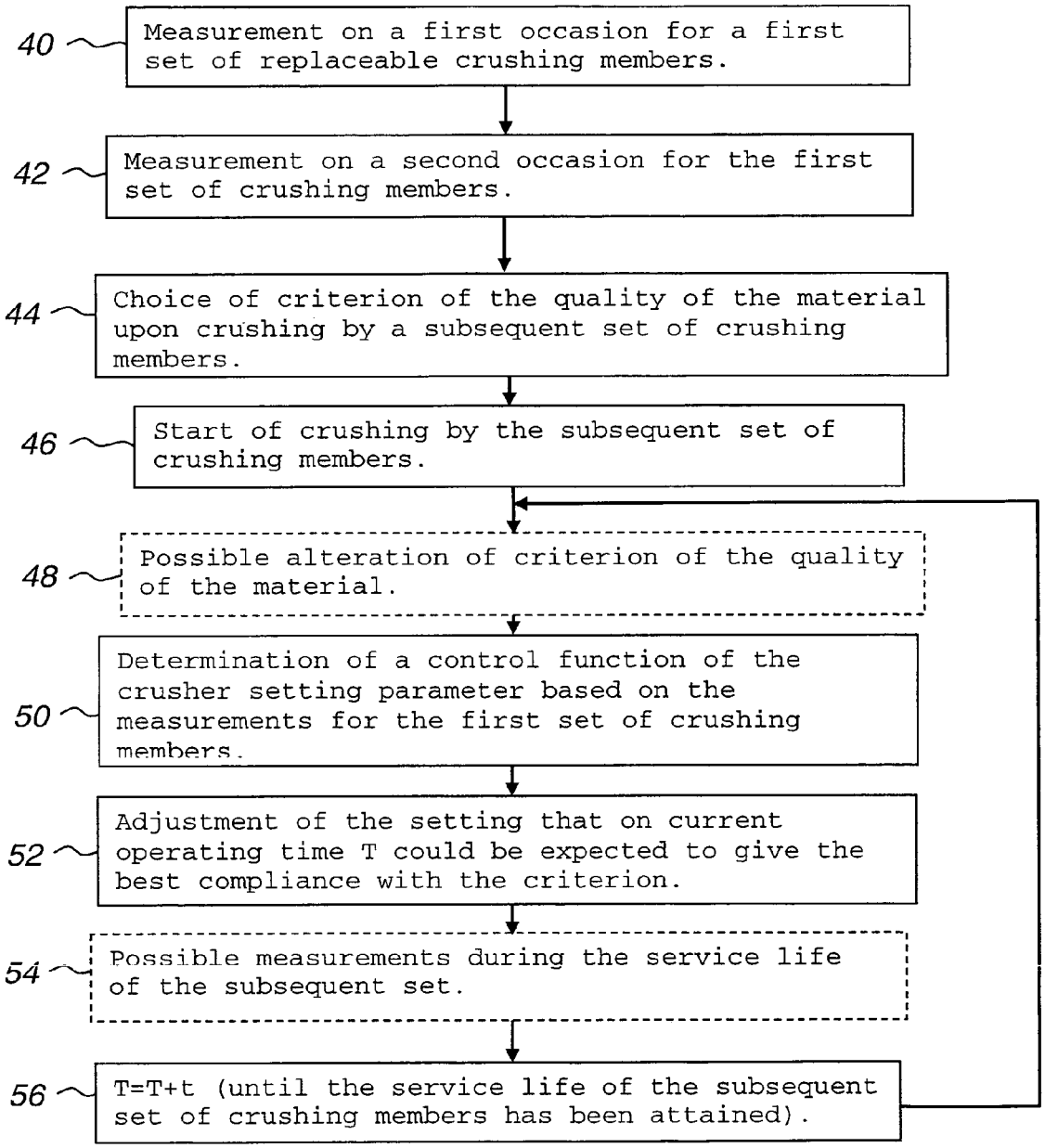
FIG. 6 is a block diagram that schematically illustrates an embodiment of a method according to the invention.

FIG. 6 schematically shows the way of compensating for wear. In step 40, a measurement is carried out, for a first set of replaceable first and second crushing members, of at least one quality parameter, such as grain size, for at least two different values of a crusher setting parameter, for instance two different shortest distance S between shells. In step 42, a second measurement of the quality parameter is carried out for two different settings of the crusher setting parameter. Step 40 is carried out on a first occasion, e.g., when the crushing members are new, and step 42 is carried out on a second occasion, e.g., immediately before the first set of crushing members become entirely worn out and the crushing members are to be substituted. Conveniently, measurements of the quality parameter may be carried out on additional occasions during the service life of the first set of replaceable crushing members. For instance, if the expected service life of the first set of crushing members is 1000 h, measurements may be carried out after 0, 300, 600 and 900 h of operation. After the first set of crushing members has become worn out, this set is substituted by a subsequent set of replaceable crushing members. In the step 44, shown in FIG. 6, a criterion is selected, which defines what is an optimum quality parameter. The criterion may, for instance, be that the amount of crushed material in a certain size interval should be maximized. The crushing by the subsequent set of crushing members is then commenced in step 46. The step 48 shown in FIG. 6 indicates a possibility of, at any time during the crushing by the subsequent set of crushing members, changing criterion of the nature of the material. For instance, it may instead be chosen to direct the crushing based on a desired value of another quality parameter, e.g., the grain shape of the crushed material. In step 50, a control function is determined, based on the measurements with the first set of crushing members, of how the crusher setting parameter should be set as a function of the occasion in question, e.g., current time, in order to meet the chosen criterion regarding the nature of the material. In step 52, the crusher is adjusted to the setting calculated in step 50. Conveniently, during the service life of the subsequent second set of crushing members, in step 54, additional measurements of the quality parameter may be made in order to improve the basis for calculation of the control function of subsequent sets of crushing members, i.e., third set, fourth set and so on. In step 56, which represents a clock that counts the operating time T during the operation using the subsequent set of shells, the time T is increased by a time t, which may be very short, e.g., 0.1 s, before any alteration of criterion of the nature of the material is possibly made in step 48. If an alteration of criterion has been made in step 48, a new control function is calculated in step 50 and the crusher is reset in step 52 according to the new control function. If no alteration of criterion has been made, in step 52, the crusher is set according to the value of the crusher setting parameter that has been calculated from the control function at the operating time T in question.

Thus, according to FIG. 6, measurements on a first set of crushing members are utilized for the calculation of the control function of subsequent, i.e., second, third, fourth, etc., sets of crushing members. It is appreciated that upon the calculation of a control function of, for instance, the fourth set of crushing members, only measurements for the first set, measurements from the first, second and third set or measurements from only the third set, may, as an example, be utilized. The choice of which of the previously made measurements should be utilized for the calculation of a control function of a subsequent set of crushing members depends on available measurements, to what extent the properties of the fed-in material to be crushed are altered over time, etc.

In Tables 1–3, exemplifying results are schematically shown from measurement of quality parameters of crushed material on three occasions. Measurements are carried out with a first set of replaceable first and second crushing members in the form of an inner shell 4 and an outer shell 5, see FIG. 2, at start (0 h) as well as after operation for 300 h and 600 h, i.e., on three totally different occasions. The measurement of quality parameters is carried out on each occasion for five different settings of the crusher setting parameter Closed Side Setting (i.e., CSS, which is the same as the distance S according to FIG. 3), namely 8, 9, 10, 11 and 12 mm. Remaining crusher setting parameters, among others the horizontal stroke of the lower end 2 of the shaft 1', the rotation speed of the shaft 1', the hydraulic pressure in the setting device 7, 8, 9, 15, and the amount of fed-in material per time unit, are kept constant and are noted so that these settings can be kept in operation using the subsequent sets of shells 4, 5. Upon the measurement, firstly the distance between the shells 4, 5 should be calibrated, such as has been described above. The two quality parameters that are measured are the size distribution of the crushed material and the shape of the grains in a selected fraction, in the example 8–11.2 mm. The size distribution is measured by sieving the crushed material, the distribution of the material (in % by weight) in four fractions (0–4 mm, 4–8 mm, 8–11.2 mm and >11.2 mm) being analysed. The grain shape is analysed by the fact that the crushed material in the fraction of 8–11.2 mm is analysed in terms of the part of grains (expressed in % by weight) in this fraction having a length of the grain of less than three times as large as the thickness of the grain, also called LT(3) index. In the example shown, it is desirable that LT(3) is as high as possible.

TABLE 1

| Measurement at start (0 h) | | | | | |
|---|---|---|---|---|---|
| Start<br>CSS (mm) | 8 | 9 | 10 | 11 | 12 |
| Size distribution (% by weight): | | | | | |
| 0–4 mm | 55 | 49 | 43 | 40 | 33 |
| 4–8 mm | 32 | 30 | 28 | 25 | 21 |
| 8–11.2 mm | 12 | 17 | 22 | 23 | 26 |
| >11.2 mm | 1 | 4 | 7 | 12 | 20 |
| Sum: | 100 | 100 | 100 | 100 | 100 |
| LT(3). 8–11.2 (% by weight): | 91.5 | 92.0 | 95.0 | 91.3 | 90.0 |

TABLE 2

| Measurement after 300 h of operation | | | | | |
|---|---|---|---|---|---|
| 300 h<br>CSS (mm) | 8 | 9 | 10 | 11 | 12 |
| Size distribution (% by weight): | | | | | |
| 0–4 mm | 56 | 51 | 45 | 40 | 34 |
| 4–8 mm | 33 | 31 | 27 | 25 | 22 |
| 8–11.2 mm | 10 | 15 | 21 | 24 | 26 |
| >11.2 mm | 1 | 3 | 7 | 11 | 18 |
| Sum: | 100 | 100 | 100 | 100 | 100 |
| LT(3), 8–11.2 mm (% by weight) | 92.0 | 94.0 | 94.0 | 91.0 | 89.8 |

TABLE 3

| Measurement after 600 h of operation | | | | | |
|---|---|---|---|---|---|
| 600 h<br>CSS (mm) | 8 | 9 | 10 | 11 | 12 |
| Size distribution (% by weight): | | | | | |
| 0–4 mm | 57 | 52 | 46 | 41 | 34 |
| 4–8 mm | 34 | 31 | 28 | 26 | 23 |
| 8–11.2 mm | 9 | 14 | 20 | 23 | 26 |
| >11.2 mm | 0 | 3 | 6 | 10 | 17 |
| Sum: | 100 | 100 | 100 | 100 | 100 |
| LT(3), 8–11.2 mm (% by weight) | 92.7 | 93.8 | 94.3 | 91.8 | 90.2 |

Figure 7:
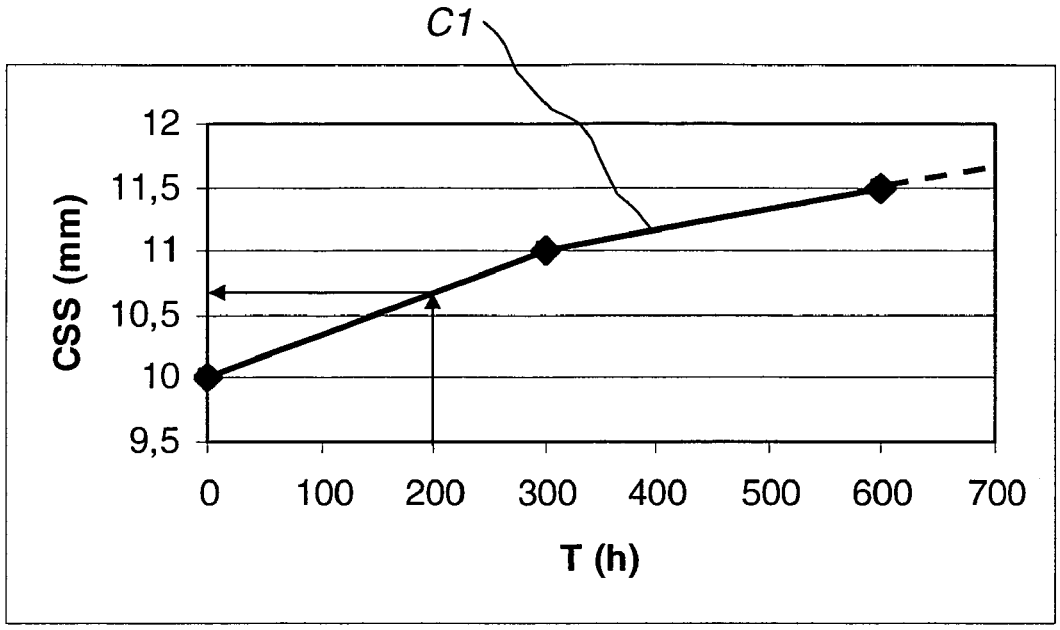
FIG. 7 is a chart and shows a first control function for use upon the control of a crusher.

The data obtained in Tables 1–3 by measurements carried out for a first set of shells is fed into the control device 11 in order to be utilized in the control of crushing by a second set of shells that are used for the crushing of a material resembling the one that was crushed by the first set of shells. FIG. 7 shows a first example of how such a control may be effected in the form of a control curve or control function C1. In this first example, as a criterion, the operator handling the crusher has selected that the part of material having a size of 4–11.2 mm shall be maximized, i.e., that the sum of the part of material in the fraction of 4–8 mm and in the fraction of 8–11.2 mm should be maximized. Thus, in this case, it is a question about the optimal value of the quality parameter of size distribution being such that the part of material in the fraction of 4–11.2 mm should be as great as possible. The operator enters this criterion into the control device 11. According to table 1, maximum compliance with the criterion is attained in new shells, i.e., 0 h of operating time, with CSS=10 mm, i.e., at a distance S between the shells of 10 mm, 28+22=50% by weight of the crushed material could be expected to have the desired size according to Table 1. However, at 300 h, it is for CSS=11 mm where the greatest part, more precisely 25+24=49% by weight, falls within the desired interval. At 600 h, 49% by weight is obtained in the desired size interval for CSS=11 mm as well as for CSS=12 mm. Based on the criterion of the quality parameter of size distribution given by the operator and the data found in Tables 1–3, the control device 11 determines a control function C1. This control function C1 states that CSS should be 10 mm at start, 11 mm at 300 h and 11.5 mm at 600 h. CSS between the given instants of time is calculated by linear interpolation. Thus, the control function C1 shown in FIG. 7 supplies the CSS that on any occasion during the service life of a set of shells could be expected to give the maximum part of material having the desired size, i.e., 4–11.2 mm. The control device 11 utilizes the control function C1 shown in FIG. 7 in order to automatically and during operation set CSS in the crusher 1 for the second set of shells by means of the setting device 7, 8, 9, 15. Thus, based on C1, a value of CSS is determined by the control device 11 and a signal is sent to the setting device 7, 8, 9, 15. As is indicated in FIG. 7, CSS at 200 h of operation, for instance, will be set to 10.66 mm by the control device 11. It is also outlined in FIG. 7 that the control function C1 has been extrapolated forward from 600 to 700 h. Such an extrapolation may be carried out in a case when it is not exactly known at what time the shells 4, 5 are worn out and when there may be a possibility of utilizing the shells in the second set somewhat longer than the operating time corresponding to the last measuring point. Analogously, in a case when the first measuring point corresponds to an operating time of, e.g., 50 h, an extrapolation backward to 0 h can be carried out when the control function is to be calculated. Upon a possible extrapolation, it is important to make it with caution, preferably based on many measurements and not extending over a long period of time counted from nearest measurement. It is also convenient not to utilize the compensation given by the extrapolation to the full extent. If the extrapolated control function states that CSS should increase linearly from 11.5 mm to 11.7 mm from 600 to 700 h of operating time, it is preferable to just effect, e.g., 70% of this increase of 0.2 mm, i.e., to increase CSS from 11.5 to 11.64 mm.

For allowing CSS, i.e., the shortest distance S between the shells 4, 5, to be directed to the correct value at the respective instant of time, it is convenient every now and then to make a calibration so as to ensure that the CSS the control device 11 operates according to corresponds with reality. It is also possible to utilize the method described in WO 93/14870, which, based on previous calibrations, compensates for the wear-dependent alteration of the shortest distance S between the shells 4, 5.

Figure 8:
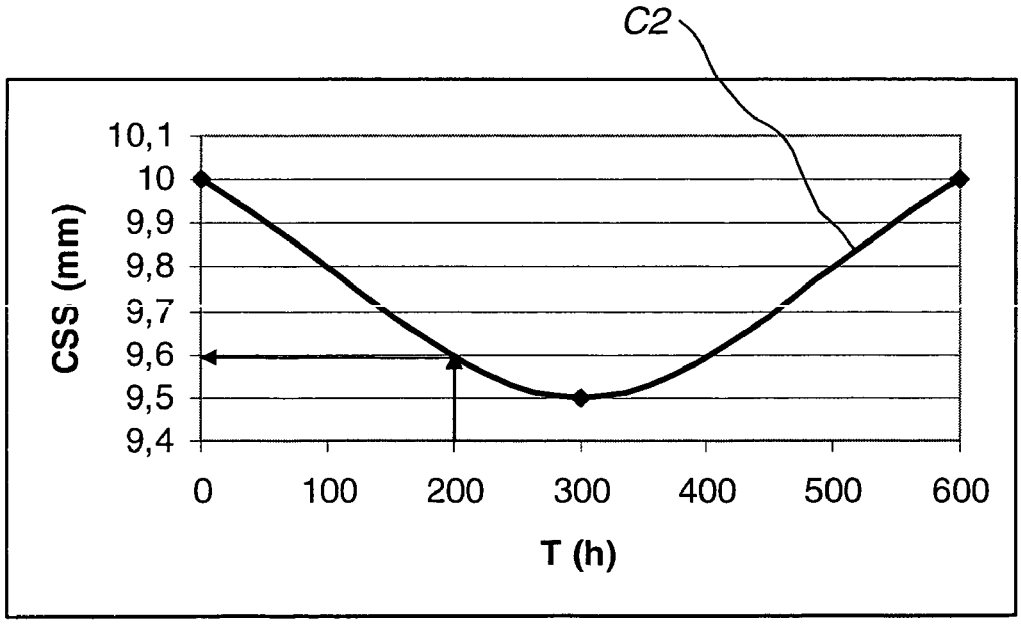
FIG. 8 is a chart and shows a second control function for use upon the control of a crusher.

In FIG. 8, a control curve or control function C2 is illustrated for a second example where the operator, for a second set of shells, chooses the criterion to produce the best possible grain shape in the fraction of 8–11.2 mm, i.e., highest possible LT(3) index in the fraction of 8–11.2 mm. Hence, in this case, it is a question of the optimal value of the quality parameter of grain shape being such that the material in the fraction of 8–11.2 mm should be as cubic as possible, i.e., that LT(3) index is as high as possible. From Tables 1–3, the control device 11 can derive that the greatest LT(3) at 0 h is obtained for CSS 10 mm, at 300 h for CSS 9 mm and 10 mm, and for 600 h at CSS 10 mm. The control function C2, see FIG. 8, is therefore determined so that CSS should be 10 mm at 0 h, 9.5 mm at 300 h and 10 mm at 600 h, and that a curve fitting should be made. As is indicated in FIG. 8, CSS at 200 h of operation, for instance, will be set to 9.60 mm by the control device 11.

As is seen in the examples described above and illustrated by means of FIG. 7 and FIG. 8, by the method and the device according to a preferred embodiment of the invention, it is possible to, based on measurements of one or more quality parameters of a first set of shells, automatically set convenient crusher setting parameters when crushing, with the same or the like material, by a second set of shells. During the crushing by the second set of shells, additional measurements are conveniently made that then are utilized, together with measuring data of the first set of shells, for the calculation of control functions of a third set of shells and so on.

It is, as has been mentioned above, possible to change criterion during operation. For instance, during a period, e.g., 0–300 h, it is possible to use a criterion of the size distribution and utilize the control function C1 shown in FIG. 7, and then, e.g., during a directly following period, e.g., 300–600 h, use a criterion of the grain shape and utilize the control function C2 shown in FIG. 8. During operation using one set of shells, this makes it possible to quickly adapt the crushing operation to meet the desired changes for the nature of the product.

Figure 9:
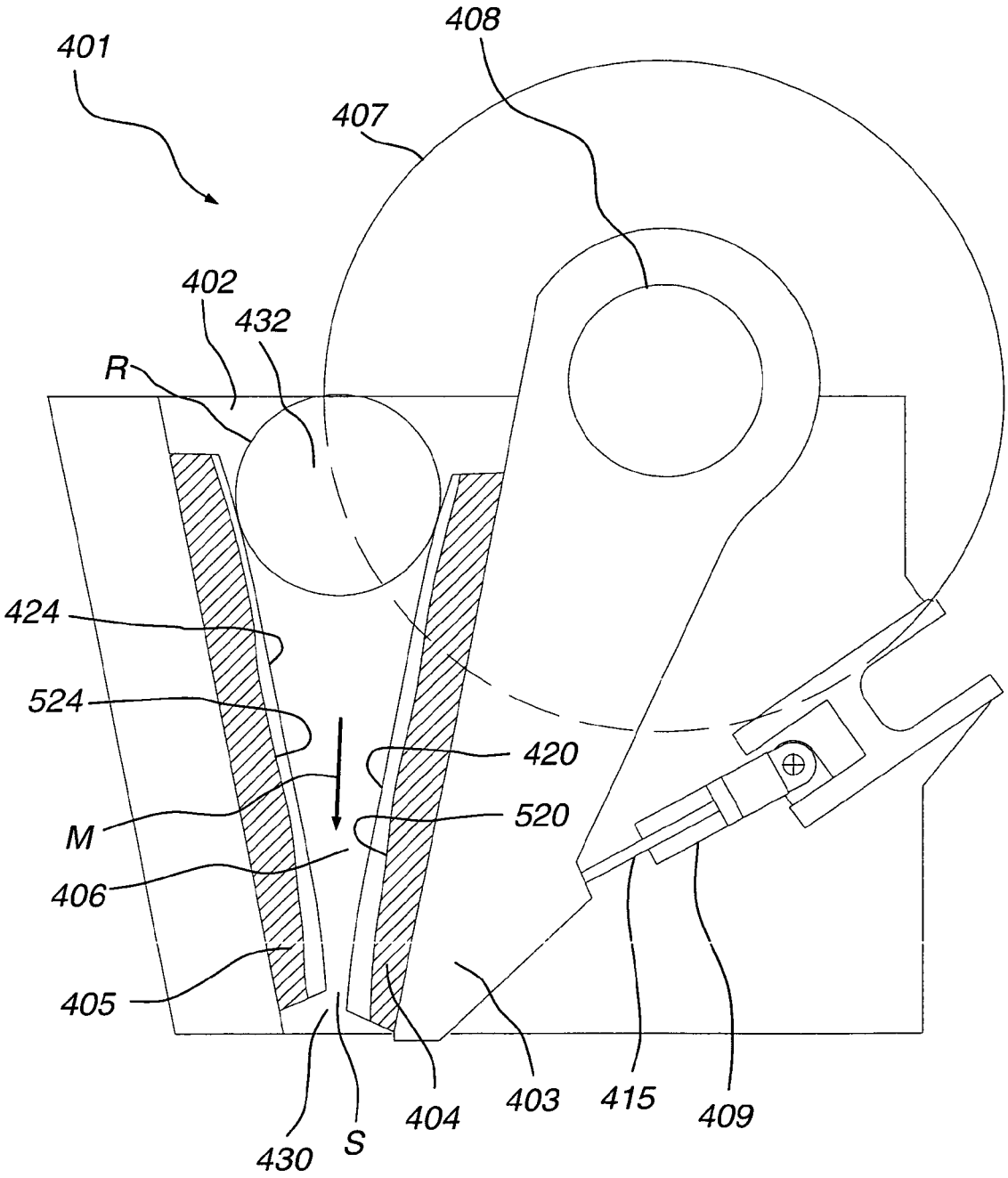
FIG. 9 is a cross-section and shows schematically a jaw crusher.

FIG. 9 schematically shows in section a jaw crusher 401, which is of the rotary crusher type. The jaw crusher 401 has a frame 402 and a jaw 403 movably connected with the same. The jaw 403 carries a first jaw plate 404, which has a first crusher surface 420. A second jaw plate 405, which has a second crusher surface 424, is fastened in the frame 402. At the upper end thereof, the movable jaw 403 is rotatably fastened on an eccentric shaft 408 on which at least one flywheel 407 is fastened, which is driven by a motor, not shown in FIG. 9. Between the first jaw plate 404 and the second jaw plate 405, a crushing gap 406 is formed, which in section, as is shown in FIG. 9, has a width decreasing in the downward direction. When the motor rotates the flywheel 407, the same will get the upper part of the movable jaw 403 to describe an ellipse and the first jaw plate 404 will thereby alternately move towards and away from the second jaw plate 405. When the jaw plates 404, 405 are new, the crusher surfaces 420, 424 thereof are, as seen in cross-section, substantially planar in the example shown in FIG. 9 (the crusher surfaces 420, 424 may, however, also be provided with different types of patterns that, for instance, increase the gripping power). Fed-in material, in FIG. 9 symbolized by a substantially spherical stone block R, will accordingly move from an inlet 432 downward in a direction M, which accordingly has a downwardly directed direction component, while it is crushed successively between the first crusher surface 420 and the second crusher surface 424 to smaller and smaller sizes. The crushed material leaves the crusher 401 via an outlet 430. Normally a shortest distance S is present between the crusher surfaces 420, 424 at the outlet 430. The distance between the crusher surfaces 420, 424 can be adjusted since the position of a so-called joint flap 415, which is jointed in the frame 402 and in the lower part of the jaw 403, is adjustable, for instance, by means of a hydraulic cylinder 409. After a time of operation, the jaw plates 404, 405 will be worn down and crusher surfaces 520, 524 will obtain another geometry than the original and also affecting the geometry and function of the crushing gap 406. In analogy with what has been described above for a gyratory crusher, for a first set of jaw plates 404, 405, it is possible to carry out measurements of at least one quality parameter, e.g., size distribution or grain shape of crushed material, for at least two different settings of a crusher setting parameter, e.g., two different shortest distances S between the plates 404, 405, two different rotation speeds of the flywheel 407, or two different horizontal strokes of the lower end of the movable jaw 403, which strokes can be adjusted by altering the angle of inclination of the joint flap 415, e.g., by displacing the fixing point of the hydraulic cylinder 409 in the frame 402. The measurements of the quality parameter for the two settings are repeated on at least two different occasions. A control function may then be calculated and, with the purpose of compensating for the alteration of the crushing gap 406 upon wear, be utilized for the setting of the crusher 401 during operation when a subsequent set of jaw plates have been mounted therein.

It will be appreciated that a great number of modifications of the embodiments and examples described above are feasible within the scope of the invention, such as it is defined by the accompanying claims.

For instance, more accurate methods of calculation, such as various regression methods, may be utilized in order to calculate a more accurate control function from measurement results, like those in Tables 1–3 above, regarding quality parameters, and thereby a more accurate value of the crusher setting parameter that on a certain occasion gives the best possible compliance with the chosen criterion.

Above, simple criteria are exemplified, i.e., control functions relating to a single quality parameter that is to be optimized. Naturally, more complex control functions may be utilized, which for instance specify that two or more quality parameters, e.g., size distribution and grain shape, should be optimized simultaneously under certain conditions. For instance, a control function may be produced that has the object of maximising the amount of material in a certain size interval but that this maximization is limited by the grain shape simultaneously not being allowed to be below a certain value. Likewise, from measurements for a set of crushing members, it is of course possible to calculate a control function that for any occasion describes the setting of a plurality of crusher setting parameters, e.g., values of both the shortest distance S and of the amount of fed-in material, provided that a plurality of crusher setting parameters have been varied during the measurement. Apart from the above-mentioned quality parameters of size distribution and grain shape, it is also possible to use other quality parameters for the control of the crusher. Examples of such quality parameters are strength values, such as for instance abrasive resistance measured according to, for instance, European Standard A 1097-1 and disintegration resistance measured according to, for instance, European Standard A 1097-2, which are measurements of the mechanical strength of the crushed material. Additional examples of quality parameters are the amount of crushed material per time unit and the amount of crushed material per energy unit, which quality parameters accordingly are measurements of the efficiency by which the crushed product has been produced and thereby also describe the nature of the material.

The fact that the crusher setting parameter is to be set to such a value that the quality parameter of the crushed material becomes substantially optimal does not necessarily mean that the value of the quality parameter always should be maximized. The fact that the quality parameter is optimal may also mean that, e.g., a grain shape is not below a certain minimum value or is within a desired interval.

Above, it is described how measurements from a first set of crushing members are utilized upon the calculation of the control function of the subsequent sets of crushing members, i.e., of second, third, etc., sets of crushing members. It is preferable also, for these second, third, etc., sets of crushing members, to carry out measurements and to utilize these measurements upon the determination of control functions of crushing members subsequent to these sets of crushing members. The additional measurements carried out have two advantages. One advantage is that the accuracy of the calculation of the control function becomes greater the more measurements it could be based on. Another advantage is that time-dependent alterations of the properties of the fed-in material, e.g., hardness, size distribution, will have an impact in the measurements. For this reason, upon the calculation of a control function of a set of crushing members, it is preferred to give most consideration to those measurements having been made for the closest preceding sets of crushing members and less, or no, consideration to those measurements having been made a relatively long time ago, when the fed-in material possibly had somewhat different properties.

According to the above, it is described how measurements are carried out on three occasions during the service life of a first set of crushing members. It is of course also possible, although less preferred, to carry out only two measurements during the service life of the first set of crushing members. It is, as an alternative, also possible to carry out one measurement during the service life of a first set of crushing members, e.g., after 100 h of operation using this first set of crushing members, and one measurement during the service life of a second set of crushing members, e.g., after 700 h of operation using this second set of crushing members, and to utilize these two measurements for the determination of a control function that is utilized for the adjustment of a crusher setting parameter upon crushing by a subsequent, third, set of crushing members.

In the examples above, it is described how measurements are carried out on a plurality of occasions, which correspond to a certain number of hours of operation, i.e., the measurements are made at certain instants of time. In certain cases, wear of the crusher surfaces is more correlated to how many tons of material have been crushed between the crusher surfaces, or how much energy the crusher surfaces have transferred to the material, than to the time the crusher surfaces have been in operation. Therefore, occasionally it is instead desirable to relate the occasions when measurements should be carried out to a certain number of tons of crushed material, a certain amount of energy consumed in the driving device of the crusher, or some other parameter correlating to the wear. In such a case, the x-axis in FIGS. 7 and 8 will not be graduated in unit of hours but instead, for instance, in unit of tons or in unit of kWh, and the control function being used for the setting of the crusher setting parameter for a subsequent set of replaceable crushing members will instead relate to the current, accumulated, amount of crushed material starting from the subsequent set, or the current, accumulated, consumed energy starting from the subsequent set, instead of to the current, accumulated, time. Thus, the control system could, for instance, measure the accumulated quantity of crushed material for the subsequent set of replaceable crushing members and when, for instance, 5000 t of material have been crushed, derive from a control function, that for instance may be based on measurements at 0, 7000 and 14000 t of crushed material by a preceding set, which setting of the crusher setting parameter that on this occasion, i.e., at 5000 t of crushed material, gives the best compliance with the quality parameter according to the chosen criterion.

As is seen from the above, the control device 11 conveniently automatically sets the correct value of the crusher setting parameter, based on a control function C1. However, an alternative solution is that the control device 11, on a display, a pointer instrument or the like, presents the value calculated from C1 of the crusher setting parameter, and that an operator manually adjusts this value of the crusher.

It is appreciated that the invention also may be applied to other types of crushers than those described above. For instance, a gyratory crusher having a hydraulic control of the vertical position of the inner shell is described above. The invention may also be applied to, among other things, crushers that have a mechanical setting of the gap between the inner and outer shell, for instance the type of crushers that is described in U.S. Pat. No. 1,894,601 in the name of Symons. In the last-mentioned type of crushers, occasionally called Symons type, the setting of the gap between the inner and outer shell is carried out by a case, in which the outer shell is fastened, being threaded in a machine frame and turned in relation to the same for the achievement of the desired gap. The invention may also be applied to other types of jaw crushers than the one described above, e.g., jaw crushers of the pendulum crusher type.

While the present invention has been described with respect to particular preferred embodiments of the present invention, this is by way of illustration for purposes of disclosure rather than to confine the invention to any specific arrangement as there are various alterations, changes, deviations, eliminations, substitutions, omissions and departures which may be made in the particular embodiments shown and described without departing from the scope of the present invention as defined only by a proper interpretation of the appended claims.

The invention claimed is:

1. A method to control a crusher which comprises a replaceable first crushing member having a first crusher surface and a replaceable second crushing member having a second crusher surface, which crushing members are arranged to be brought toward each other in a reciprocating motion to crush, between one another, a material that passes between the crusher surfaces in a direction having a vertically downwardly directed direction component, said method comprising:

defining the co-operation of the crusher surfaces by at least one crusher setting parameter, measuring at least one quality parameter, which relates to the nature of the crushed material, on at least two different occasions during the service life of at least one set of replaceable first and second crushing members and on each occasion for at least two different settings of the crusher setting parameter, and utilizing the measured quality parameter for said set of replaceable crushing members for determining a control function that describes a value, of said at least one crusher setting parameter, which on a given occasion gives a crushed material the quality parameter of which is substantially optimal, and utilizing the control function for adjusting the crusher setting parameter for a subsequent set of replaceable first and second crushing members in such a way that on a given occasion for the subsequent set of replaceable crushing members, a crushed material is obtained said quality parameter of which being substantially optimal.

2. The method according to claim 1, wherein determining the control function includes selecting a criterion, which defines what is an optimum quality parameter, and determining the values of the crusher setting parameter that best fulfil said criterion from the quality parameters measured on the respective occasions, and determining the control function as a curve fitted to said values of the crusher setting parameter.

3. The method according to claim 1, further comprising measuring quality parameters for at least two different sets of replaceable crushing members and utilizing the measured quality parameters for said at least two different sets of replaceable crushing members for determining the control function.

4. The method according to claim 1, further comprising measuring at least one quality parameter, which relates to the nature of the crushed material, on at least three different occasions and utilizing the measured quality parameters for determining the control function.

5. The method according to claim 1, wherein each measurement is carried out for at least three different settings of the crusher setting parameter.

6. The method according to claim 1, further comprising extrapolating the control function in order to cover the entire time during which the subsequent set of replaceable crushing members are used.

7. The method according to claim 1, further comprising selecting said at least one crusher setting parameter from the group consisting of: the shortest distance between the first crusher surface and the second crusher surface, the power generated by a motor driving the crusher, the quantity of material fed into the crusher, the rotation speed of a shaft rotating a crushing head in a gyratory crusher, the horizontal stroke of a lower end of the shaft in the gyratory crusher, the pressure by which the shaft in the gyratory crusher loads a setting device that sets the position of the shaft in the vertical direction, the rotation speed of a flywheel driving a movable jaw in a jaw crusher, and the horizontal stroke of the lower end of the movable jaw in a jaw crusher.

8. The method according to claim 7, wherein said selecting at least one crusher setting parameter comprises selecting a parameter that describes the shortest distance between the first crusher surface and the second crusher surface.

9. The method according to claim 1, further comprising selecting said at least one quality parameter of the crushed material from the group consisting of: grain shape, size distribution, strength value, quantity of crushed material per time unit, and quantity of crushed material per energy unit.

10. The method according to claim 1, wherein said given occasion includes a given operating time, a given quantity of material having been crushed, or a given quantity of energy having been consumed in the crushing.

11. A crusher comprising:

a replaceable first crushing member having a first crusher surface and a replaceable second crushing member having a second crusher surface, said crushing members being arranged to be brought toward each other in a reciprocating motion and so as to crush therebetween a material that passes between the crusher surfaces in a direction having a vertically downwardly directed direction component, wherein cooperation of the crusher surfaces is defined by at least one crusher setting parameter;

a control device utilizing at least one measured quality parameter, which relates to the nature of the crushed material and which has been measured on at least two different occasions during the service life of at least one set of replaceable first and second crushing members and on each occasion for at least two different settings of the at least one crusher setting parameter, to determine a control function that describes a value of said at least one crusher setting parameter, which on a given occasion gives a crushed material the quality parameter of which is substantially optimal, and to utilize the control function to adjust said at least one crusher setting parameter for a subsequent set of replaceable first and second crushing members in such a way that on a given occasion for the subsequent set of replaceable crushing members, a crushed material maybe obtained said quality parameter of which is substantially optimal.

12. A control system for the control of a crusher which comprises a replaceable first crushing member having a first crusher surface and a replaceable second crushing member having a second crusher surface, said crushing members being arranged to be brought toward each other in a reciprocating motion and so as to crush therebetween a material that passes between the crusher surfaces in a direction having a vertically downwardly directed direction component, the control system comprising:

a control device, utilizing at least one measured quality parameter, which relates to the nature of the crushed material and which has been measured on at least two different occasions during the service life of at least one set of replaceable first and second crushing members, wherein the cooperation of the crusher surfaces is defined by at least one crusher setting parameter, and on each occasion for at least two different settings of said crusher setting parameter, to determine a control function that describes a value of said at least one crusher setting parameter, which on a given occasion gives a crushed material the quality parameter of which is substantially optimal, and utilize said control function for the adjustment of said at least one crusher setting parameter for a subsequent set of replaceable first and second crushing members in such a way that on a given occasion for the subsequent set of replaceable crushing members, a crushed material can be obtained said quality parameter of which is substantially optimal.

* * * * *